US005600866A

United States Patent [19]

Berfield

[11] Patent Number: 5,600,866

[45] Date of Patent: Feb. 11, 1997

[54] CLEANING FLUID TANK ASSEMBLY

[75] Inventor: Robert C. Berfield, Jersey Shore, Pa.

[73] Assignee: Shop Vac Corporation, Williamsport, Pa.

[21] Appl. No.: 571,157

[22] Filed: Dec. 12, 1995

[51] Int. Cl.[6] ..... A47L 11/34

[52] U.S. Cl. ..... 15/322; 15/320

[58] Field of Search ..... 15/320, 321, 322

[56] References Cited

U.S. PATENT DOCUMENTS

| | | |
|---|---|---|
| 965,315 | 7/1910 | Moorhead . |
| 1,461,947 | 7/1923 | Sporer . |
| 1,592,882 | 7/1926 | Artas . |
| 1,661,480 | 3/1928 | Keefer . |
| 1,982,345 | 11/1934 | Kirby . |
| 2,718,656 | 9/1955 | Kirk . |
| 2,757,406 | 8/1956 | Decker . |
| 2,909,800 | 10/1959 | Grindle et al. . |
| 3,079,285 | 2/1963 | Rockwell . |
| 3,118,165 | 1/1964 | Meyerhoefer . |
| 3,355,762 | 12/1967 | Cavell et al. . |
| 3,496,592 | 2/1970 | Jones . |
| 3,584,330 | 6/1971 | Wallin et al. . |
| 3,604,049 | 9/1971 | Hetman . |
| 3,720,977 | 3/1973 | Brycki . |
| 3,818,537 | 6/1974 | Evans . |
| 3,909,197 | 9/1975 | Cremers . |
| 3,939,515 | 2/1976 | Platek . |
| 3,942,217 | 3/1976 | Bates . |
| 3,977,797 | 8/1976 | Paterson . |
| 4,123,818 | 11/1978 | Hurwitz . |
| 4,138,760 | 2/1979 | Cadle . |
| 4,153,968 | 5/1979 | Perkins . |
| 4,164,055 | 8/1979 | Townsend . |
| 4,185,354 | 1/1980 | Brazier . |
| 4,216,563 | 8/1980 | Cyphert . |
| 4,218,805 | 8/1980 | Brazier . |
| 4,226,000 | 10/1980 | Tribolet . |
| 4,287,636 | 9/1981 | Brazier . |
| 4,314,385 | 2/1982 | Wimsatt et al. . |
| 4,318,202 | 3/1982 | Holman . |
| 4,353,145 | 10/1982 | Woodford . |
| 4,397,057 | 8/1983 | Harbeck . |
| 4,458,377 | 7/1984 | Frohbieter . |
| 4,485,518 | 12/1984 | Kasper . |
| 4,507,819 | 4/1985 | Martinec ..... 15/321 |
| 4,531,257 | 7/1985 | Passien . |
| 4,534,083 | 8/1985 | Hampson . |
| 4,557,013 | 12/1985 | Belmont . |
| 4,597,124 | 7/1986 | Williams, III et al. . |
| 4,654,926 | 4/1987 | McCambridge . |
| 4,670,062 | 6/1987 | Lester . |
| 4,776,058 | 10/1988 | Garner et al. . |
| 4,776,716 | 10/1988 | Huang . |
| 4,788,738 | 12/1988 | Monson et al. . |
| 4,801,376 | 1/1989 | Kulitz . |
| 4,809,396 | 3/1989 | Houser . |
| 4,825,496 | 5/1989 | Taylor . |
| 4,845,802 | 7/1989 | Miller et al. . |
| 4,864,681 | 9/1989 | Hult et al. . |
| 4,887,330 | 12/1989 | Woodhall et al. . |
| 4,899,418 | 2/1990 | Steiner et al. . |
| 4,934,017 | 6/1990 | Kent . |
| 4,954,001 | 9/1990 | Billat . |
| 4,955,104 | 9/1990 | Miller . |
| 4,961,246 | 10/1990 | Hauge et al. . |
| 4,984,328 | 1/1991 | Berfield . |
| 5,001,806 | 3/1991 | Gurstein . |
| 5,060,342 | 10/1991 | Brazier . |

(List continued on next page.)

FOREIGN PATENT DOCUMENTS

| | | |
|---|---|---|
| 0176696A2 | 4/1986 | European Pat. Off. . |
| 0343129A2 | 11/1989 | European Pat. Off. . |
| 2428429 | 1/1980 | France . |
| 2611480A1 | 9/1988 | France . |

*Primary Examiner*—Chris K. Moore

*Attorney, Agent, or Firm*—Marshall, O'Toole, Gerstein, Murray & Borun

[57] ABSTRACT

A fluid tank assembly for use with a vacuum cleaner includes a tank and a spray nozzle interconnected with the tank by a tube. The assembly is adapted to be mounted on a suction nozzle of the vacuum cleaner.

9 Claims, 3 Drawing Sheets

U.S. PATENT DOCUMENTS 5,067,199 11/1991 Alazet .
5,103,526 4/1992 Berfield .
5,103,527 4/1992 Holland ..... 15/322
5,189,755 3/1993 Yonkers et al. .
5,210,902 5/1993 Lee et al. .
5,241,724 9/1993 Lim ..... 15/321 X
5,263,224 11/1993 Lovelady .
5,280,666 1/1994 Wood et al. .
5,287,587 2/1994 Yonkers et al. .
5,287,588 2/1994 Gurstein et al. .
5,289,611 3/1994 Yonkers et al. .
5,341,541 8/1994 Sham .
5,364,198 11/1994 Skenderi .
5,367,740 11/1994 McCray .
5,377,382 1/1995 Bores et al. .
5,386,612 2/1995 Sham .
5,473,792 12/1995 Kent et al. ..... 15/320

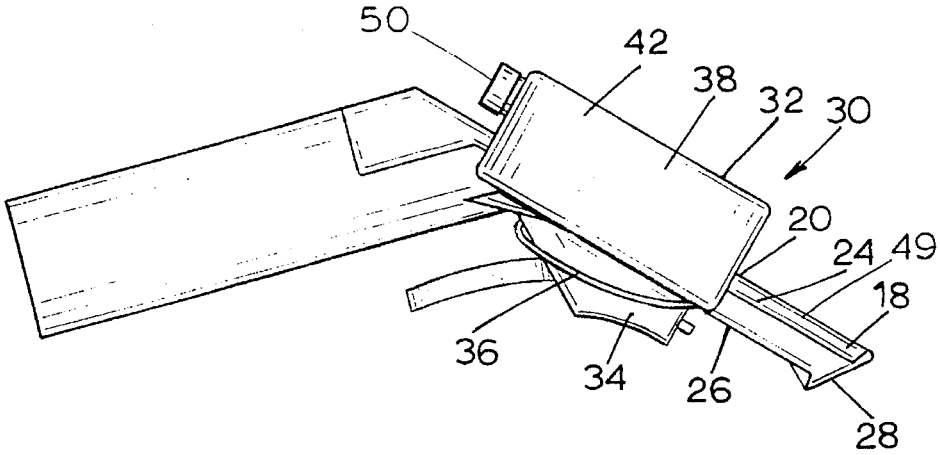
FIG. 4
FIG. 5
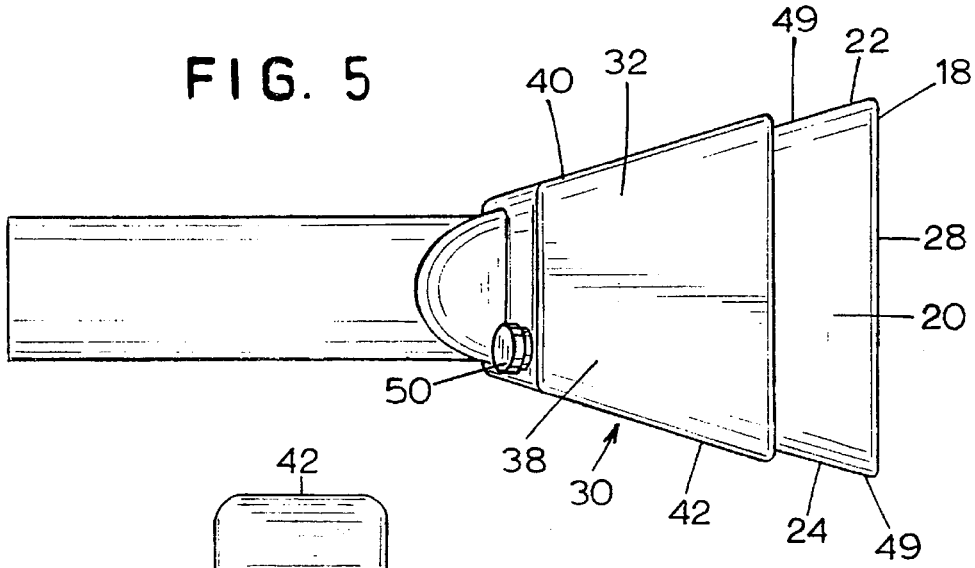
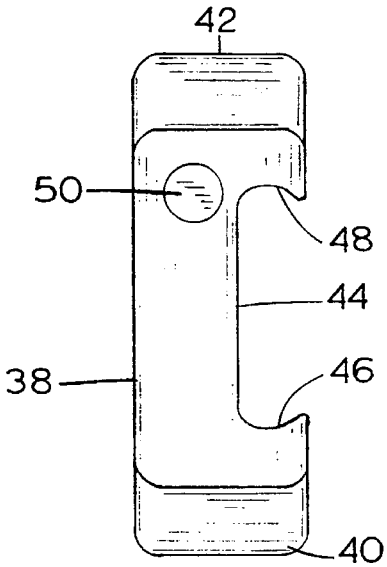
FIG. 6

CLEANING FLUID TANK ASSEMBLY

TECHNICAL FIELD

The present invention relates generally to vacuum cleaners, and more particularly to a tank assembly adapted for use on an end of a vacuum cleaner nozzle.

BACKGROUND ART

Wet/dry vacuum cleaners have long been used to pick up dry or wet debris. Typically, a wet/dry vacuum cleaner includes a hose and a nozzle fitted on the end of the hose wherein the nozzle includes a wide opening adapted to engage a surface to be cleaned. While such devices have proved to be highly useful in certain environments, for example, in home and commercial shops, their usefulness in other applications, such as to clean upholstery or fabrics, is limited.

Numerous devices have been designed to clean carpets, upholstery, draperies or the like. For example, Miller et al. U.S. Pat. No. 4,845,802, Woodhall et al. U.S. Pat. No. 4,887,330 and Miller U.S. Pat. No. 4,955,104, all owned by the assignee of the present application, disclose various devices for dispensing cleaning fluid to a surface to be cleaned and a suction nozzle for picking up the cleaning fluid.

Other patents disclosing cleaning apparatus having cleaning fluid delivery devices and suction nozzles include Moorhead U.S. Pat. No. 965,315, Chamberlin et al. U.S. Pat. No. 2,270,579, Williams, III et al. U.S. Pat. No. 4,597,124, Monson et al. U.S. Pat. No. 4,788,738, Gurstein U.S. Pat. No. 5,001,806, McCray U.S. Pat. No. 5,367,740 and Sham U.S. Pat. No. 5,386,612.

SUMMARY OF THE INVENTION

In accordance with the present invention, a fluid tank assembly is adapted for use with a nozzle of a vacuum cleaner.

More particularly, in accordance with a first aspect of the present invention, a fluid tank assembly includes a tank having a main body and first and second side walls adapted to matingly engage a first main surface and first and second side surfaces, respectively, of a vacuum cleaner nozzle. A manually operable spray nozzle is mounted on a second main surface of the vacuum cleaner nozzle opposite the first main surface. Means are provided for interconnecting the tank and the spray nozzle such that fluid stored in the tank is delivered through the interconnecting means and the spray nozzle.

Preferably, the interconnecting means comprises a tube and the tank includes a fill opening and a cap removably disposed in the fill opening. Also preferably, the spray nozzle includes a trigger which is reciprocable to pump fluid out of the spray nozzle. Still further, the side walls of the tank preferably include inner surfaces in contact with the first and second side surfaces that diverge away from one another toward an inlet end of the vacuum cleaner nozzle.

In accordance with a second aspect of the present invention, a fluid tank assembly includes a tank having a main body and first and second side walls adapted to matingly engage a first main surface and first and second side surfaces, respectively, of a vacuum cleaner nozzle wherein the side walls of the tank include inner surfaces in contact with the first and second side surfaces that diverge away from one another toward an inlet end of the vacuum cleaner nozzle. A manually operable spray nozzle is mounted on a second main surface of the vacuum cleaner nozzle opposite the first main surface. A tube interconnects the tank and the spray nozzle such that fluid stored in the tank is delivered through the tube and the spray nozzle.

Other features and advantages of the present invention with become apparent from the attached specification and drawings.

BRIEF DESCRIPTION OF THE DRAWINGS

FIGS. 3 and 6, are bottom and end elevational views of the tank of FIG. 2; and FIGS. 4 and 5, are side elevational and plan views, respectively, of the present invention as assembled on the nozzle of FIGS. 1 and 2.

DESCRIPTION OF THE PREFERRED EMBODIMENTS

Figure 1:
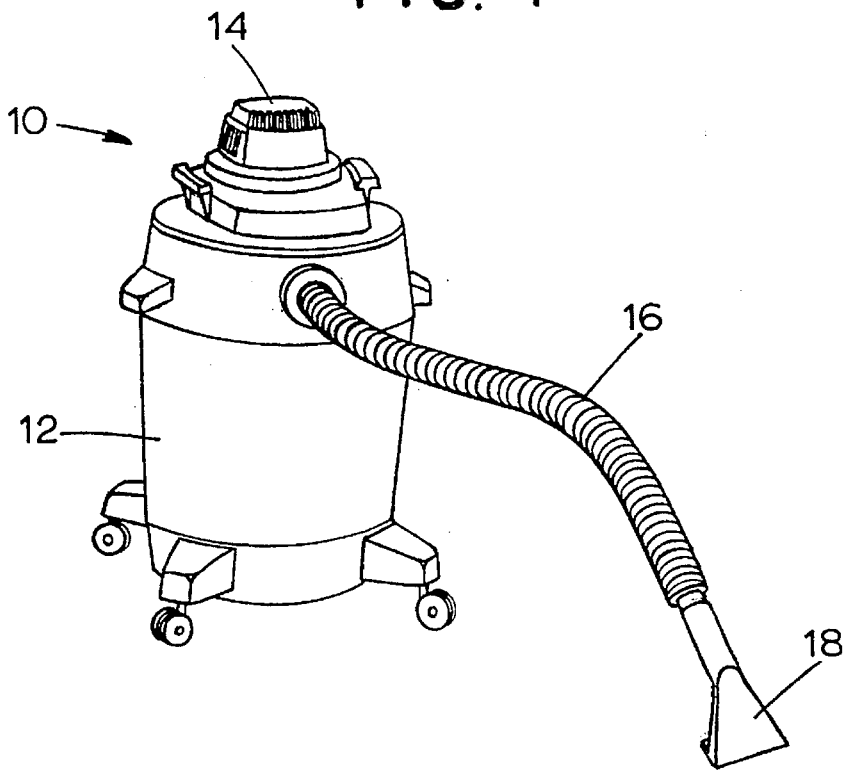
FIG. 1 comprises a perspective view of a wet/dry vacuum with which the present invention may be used.
Figure 3:
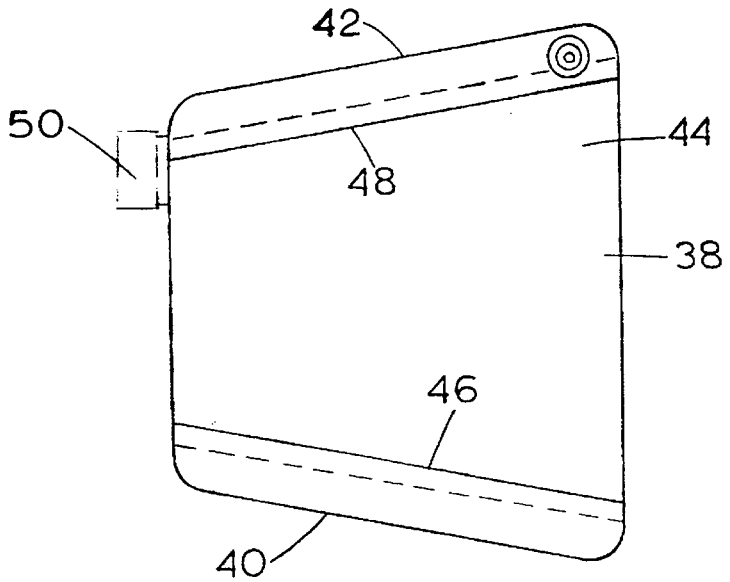

Referring first to FIG. 1, a wet/dry vacuum cleaner 10 includes a tank 12 and a head 14 containing an electric motor and impeller (not shown) for creating suction. A hose 16 is coupled to the tank 12 and a suction nozzle 18 is coupled to the hose 16.

Figure 2:
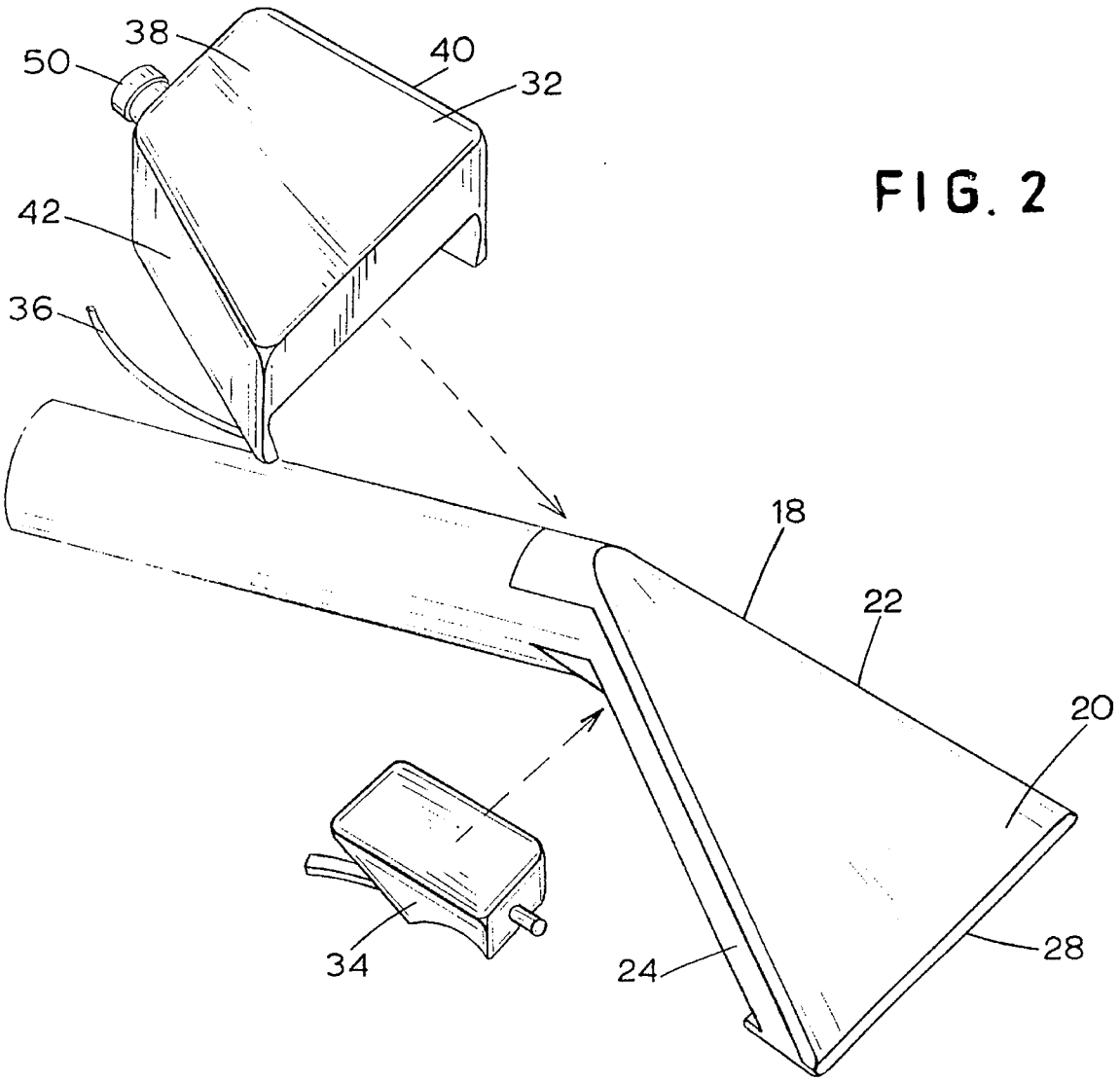
FIG. 2 comprises a fragmentary, exploded, perspective view of the nozzle of FIG. 1 together with components of the present invention.

As seen also in FIGS. 2, 4 and 5, the nozzle 18 includes a first or upper main surface 20, first and second side surfaces 22,24 and a second or lower main surface 26 opposite the first main surface 20. The first and second side surfaces 22,24 diverge away from one another toward an inlet end 28 of the nozzle 18.

Referring now to FIGS. 2–6, a fluid tank assembly 30 includes a tank 32 interconnected with a spray nozzle 34 by a tube 36. The tank 32 includes a main body 38 and first and second side walls 40,42. The main body 38 and the side walls 40,42 include inner surfaces 44,46,48, respectively, (FIGS. 3 and 6) that matingly and frictionally engage the side surfaces 22,24, respectively, when the tank 32 is placed on the nozzle 18. Because the side surfaces 22,24 and the inner surface 44 are tapered, and because the inner surfaces 46,48 are undercut to accomodate outwardly directed flanges 49 at the top of each side surface 22,24 the tank 32 is securely removably retained by gravity on the nozzle 18. If necessary or desirable, one or more fastening devices may be used to secure the tank 32 to the nozzle 18, although the tank 32 is preferably easily removable from the nozzle 18 so that filling of the tank 32 with cleaning solution is facilitated.

The tank 32 is hollow and includes a fill cap 50 which is insertable into an opening of the tank.

The spray nozzle 34 is secured to the second surface 26 by any appropriate means, such as a screw. The tube 36 is connected at opposite ends thereof to the tank 32 and the spray nozzle 34.

The assembly is prepared for use by removing the tank 32 from the nozzle 18 and removing the fill cap 50 from the opening. The tank 32 is then filled with cleaning fluid through the opening, the fill cap 50 is replaced in the opening and the tank 32 is mounted on the nozzle 18. During operation of the vacuum cleaner 10, cleaning fluid may be sprayed on a surface to be cleaned by manually pumping the spray nozzle 34 and the fluid may be picked up by the suction at the inlet end 28 of the nozzle 18.

If desired, the assembly may utilize a differently shaped tank for use on other types of nozzles.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A fluid tank assembly, comprising:

a tank having a main body and first and second side walls adapted to matingly engage a first main surface and first and second side surfaces, respectively, of a vacuum cleaner nozzle;

a manually operable spray nozzle mounted on a second main surface of the vacuum cleaner nozzle opposite the first main surface; and means for interconnecting the tank and the spray nozzle such that fluid stored in the tank is delivered through the interconnecting means and the spray nozzle.

2. The fluid tank assembly of claim 1, wherein the interconnecting means comprises a tube.

3. The fluid tank assembly of claim 1, wherein the tank includes a fill opening and a cap removably disposed in the fill opening.

4. The fluid tank assembly of claim 1, wherein the spray nozzle includes a trigger which is reciprocable to pump fluid out of the spray nozzle.

5. The fluid tank assembly of claim 1, wherein the side walls of the tank include inner surfaces in contact with the first and second side surfaces that diverge away from one another toward an inlet end of the vacuum cleaner nozzle.

6. A fluid tank assembly, comprising:

a tank having a main body and first and second side walls adapted to matingly engage a first main surface and first and second side surfaces, respectively, of a vacuum cleaner nozzle wherein the side walls of the tank include inner surfaces in contact with the first and second side surfaces that diverge away from one another toward an inlet end of the vacuum cleaner nozzle;

a manually operable spray nozzle mounted on a second main surface of the vacuum cleaner nozzle opposite the first main surface; and a tube interconnecting the tank and the spray nozzle such that fluid stored in the tank is delivered through the interconnecting means and the spray nozzle.

7. The fluid tank assembly of claim 6, wherein the spray nozzle includes a trigger which is reciprocable to pump fluid out of the spray nozzle.

8. The fluid tank assembly of claim 7, wherein the tank includes a fill opening and a cap removably disposed in the fill opening.

9. The fluid tank assembly of claim 6, wherein the side walls of the tank are undercut to accommodate flanges of the side surfaces of the vacuum cleaner nozzle.

* * * * *